US005370789A

United States Patent [19]

Milne et al.

[11] Patent Number: 5,370,789

[45] Date of Patent: Dec. 6, 1994

[54] ULTRAPYROLYTIC HEAVY OIL UPGRADING IN AN INTERNALLY CIRCULATING AERATED BED

[75] Inventors: Bruce J. Milne; Franco Berruti; Leo A. Behie, all of Calgary, Canada

[73] Assignee: Energy Mines & Resources Canada, Ottawa, Canada

[21] Appl. No.: 190,997

[22] Filed: Feb. 3, 1994

[51] Int. Cl.[5] ..... C10G 9/32; C10G 39/14

[52] U.S. Cl. ..... 208/126; 208/132; 208/160; 208/163; 208/164

[58] Field of Search ..... 208/126, 127, 130, 132, 208/128, 163, 164, 173, 174; 585/651, 652, 921, 922, 924, 926; 422/145, 146

[56] References Cited

U.S. PATENT DOCUMENTS

| | | | |
|---|---|---|---|
| 2,337,684 | 12/1943 | Scheineman | 196/52 |
| 2,849,384 | 8/1958 | Voorhies, Jr. et al. | 196/55 |
| 2,868,719 | 1/1959 | Martin et al. | 208/157 |
| 3,123,547 | 3/1964 | Palmer et al. | 208/78 |
| 3,202,603 | 8/1965 | Keith et al. | 203/107 |
| 3,254,019 | 5/1966 | Mitchell et al. | 208/87 |
| 4,446,009 | 5/1984 | Bartholic | 208/113 |
| 4,816,136 | 3/1989 | Allan et al. | 208/127 |
| 5,062,945 | 11/1991 | Pappal et al. | 208/113 |

*Primary Examiner*—Asok Pal
*Assistant Examiner*—Bekir L. Yildirim

[57] ABSTRACT

A process is described for ultrapyrolytic upgrading of a heavy hydrocarbon oil feedstock by contacting the feedstock in a confined riser vertical column with finely divided inert solid particles under ultrapyrolysis conditions, the riser forms part of an internally circulating aerated bed reactor with the bottom end of the riser being directly connected to an inlet nozzle feeding the heavy hydrocarbon oil feedstock and the upper end of the riser extending above an annular aerated bed of the finely divided solid particles surrounding the riser. The riser also includes a plurality of orifices in a lower region thereof flow connected to a lower region of the aerated bed for controlled delivery of the particles from the aerated bed into the riser. The novel feature comprises continuously feeding an atomized stream of the heavy hydrocarbon oil feedstock upwardly through the inlet nozzle into the riser, continuously feeding finely divided solid heat carrier particles from the annular aerated bed into the riser through the orifices, contacting the particles and atomized feed within the riser under ultrapyrolysis conditions, continuously maintaining a level of particles in the aerated bed such that there is a net positive pressure difference between the aerated bed and the riser at the level of the orifices whereby riser gases are prevented from escaping into the annular bed, continuously removing particles and product gas from the upper end of the riser, continuously recycling the removed particles into the aerated bed and continuously withdrawing product gas from the system.

12 Claims, 5 Drawing Sheets

ULTRAPYROLYTIC HEAVY OIL UPGRADING IN AN INTERNALLY CIRCULATING AERATED BED

BACKGROUND OF THE INVENTION

This invention relates to a process for upgrading heavy hydrocarbon oils.

There is a growing need for new methods of exploiting Canada's remaining energy resources in the most economical and efficient way. In particular, because of vast existing resources in the form of heavy hydrocarbon oils, e.g. heavy oils and tar sands bitumens, there is an urgent need to develop more efficient means for upgrading these heavy feedstocks.

One technology that has been investigated in recent years is thermal pyrolysis of the heavy hydrocarbons. One such pyrolysis technique is known as ultrapyrolysis. In ultrapyrolysis, reactants are heated at maximum rates in the order of $10^{5°}$ K/s to temperatures in the range of 600° to 1000° C. with resident times of less than 950 milliseconds. Ultrapyrolysis of heavy oils has proved to be an effective method by which these hydrocarbons can be upgraded to low viscosity fluids and valuable products, such as olefins, while greatly reducing the undesirable coke deposition.

Spouted beds have been recognized for many years as a distinct method of contacting solids and fluids. In the spouted bed, fluid is introduced at a single orifice in the bottom of a vessel containing large granular solids. If the bed height is below a certain maximum value, the fluid clears a passage up through the bed and the bed is said to be "spouting". In passing through the spouted bed, the fluid entrains granular solid material which is carried up the spout with it. On emerging from the top of the bed, the fluid jet diverges and loses momentum and its capacity for transporting the entrained solids is considerably reduced. These solids thus rain out and settle on top of the annular bed around the spout, which continues to exist where the original bed was.

Particularly for achieving conditions for ultrapyrolysis in a spouted bed, a draft tube may be included. The draft tube is a tube located within the bed such that it is actually aligned with the spouting fluid inlet. It is located some distance up from the inlet and extends out of the top of the bed. The distance between the spout inlet and the draft tube is termed the entrainment section since this is the area within the bed where there is a transfer of solids from the annular region surrounding the draft tube to the spout.

In a conventional spouted bed, the spout is in continual contact with the annular solids over the entire height of the bed and so to exist, the spout jet must be able to support the surrounding annular bed. In order to provide this support, the spout must be of greater pressure than the annulus. Because of this pressure difference, there is a continual percolation of spouting gas into the annulus. If the bed is too deep, the spout cannot support the bed and collapses. The bed height at which the transition from spouting to collapse occurs is the maximum spoutable bed height.

The inclusion of a draft tube removes the bed height limitation. By physically separating the spout from the annulus, it provides support for the annular solids. More importantly, the draft tube also provides or, at least, reduces the loss of spout gas and the entrained solids act as the heat carrier. Because of the high differential velocity between the solids as they are entrained and the entraining gas, the transfer of heat from the solids to the carrying gas is very high. Having confined the reactant, the draft tube essentially becomes the tubular reactor.

Bartholic, U.S. Pat. No. 4,446,009 describes a selective vaporization process for decarbonizing and demetallizing heavy hydrocarbon fractions in a riser column. That system uses a temperature of about 500° C. and a residence time of about 2 seconds.

Circulating fluidized bed systems are also widely described in the literature, for example in Voorhies et al, U.S. Pat. No. 2,849,384, which shows a fluid coking system which uses a draft tube with recirculation of solid particles. However, such systems are not designed for ultrapyrolysis.

A major problem with most systems used for upgrading heavy oils is the large amounts of coke produced because of the long contact times. For instance, conventional pyrolysis upgrading reactors available commercially, such as fluid bed cokers, may lay down as much as 20% coke, while delayed cokers may yield up to 30% coke from heavy oils.

It is the object of the present invention to provide an improved internally circulating fluidized bed reaction process and system for ultrapyrolysis of heavy hydrocarbon oil.

It is a further object of the invention to be able to upgrade heat oils in a low pressure reactor (e.g. a pressure of less than 20 atmospheres) under conditions where coke yields are significantly less than 10%.

SUMMARY OF THE INVENTION

The present invention relates to the ultrapyrolytic upgrading of heavy hydrocarbon oil using an internally circulating aerated bed reactor specially adapted to this purpose. In the system of this invention, a riser or draft tube extends vertically through an annular bed of aerated heat carrier particles. This bed of aerated particles has an upward flow of gas and the flow rate may be above or below that required to create a fluidized bed. The bottom end of this riser is directly connected to an inlet nozzle through which atomized heavy hydrocarbon oil enters the riser. The upper end of the riser extends above the aerated bed of particles and includes a top portion for inertial separation of solid particles from riser gas. The riser or draft tube also includes a series of openings or orifices adjacent the lower end of the aerated bed through which solid heat carrier particles pass from the annular bed into the riser.

The level of the solid particles in the annular region is maintained so that there is a net positive pressure difference between the annular region and the riser at the level of the orifices. In this manner, the riser gases are prevented from escaping into the annular region. Gas is also introduced through a distributor into the annular region surrounding the riser and a fraction of this auxiliary gas also flows through the orifices, thereby enhancing and controlling the radial flow of the heat carrier solid particles into the riser from the annular bed and ensuring high solid particle circulation rates. In this manner, the gas residence time is completely determined by the riser gas flow rate and the fraction of auxiliary gas entering the riser or draft tube, through orifices at the bottom.

A major problem with the operation of a classic spout-fluid bed with a riser or draft tube has been lack of stability in the operation of the spout-fluid bed, especially at ultrapyrolysis temperatures. The lack of stability problems of the prior systems have been solved according to this invention by addressing the problem of gas bypassing. As described above, to solve this problem, the riser was firstly fixed directly to the inlet gas nozzle and a number of holes or orifices were positioned in the wall of the riser near its base. By controlling the size and number of orifices and by maintaining the level of the solids in the annular region such that there is a net positive pressure difference between the annular region and the riser at the level of the orifices, the riser gases are prevented from escaping into the annular region thereby effectively eliminating the gas bypassing. In ultrapyrolytic processes, control of residence time at reaction temperature is critical and the system of this invention provides the necessary control because the gas residence time can be completely determined by the riser gas flow rate and the fraction of auxiliary gas entering the riser through the orifices.

With the process of this invention, it has been found that the rate of recirculation of the heat carrier particles can be precisely controlled. This is achieved by controlling the flow rates of the auxiliary gas and riser gas. It has also surprisingly been found that the solids mass flux up the riser may be as high as 1000 $kg/m^2$ of riser cross-sectional area per second. This is important for achieving desirable high heat transfer rates.

The heavy hydrocarbon oils used as feedstock in the present invention are typically heavy oils or tar sand bitumens, a substantial proportion of which boil at temperatures above 524° C. Many of these oils may contain more than 50% by volume of material which boils above 524° C. The oil is preferably fed as an atomized spray having droplet sizes of less than 250 μm.

The solid particles forming the aerated bed can be selected from a wide variety of particulate materials that are essentially inert under process conditions or may have certain catalytic properties. The inert particulate materials may include silica sand, frac sand, fluid coke particles, etc. A convenient inert material for this purpose is silica sand, typically having mean particle sizes in the range of about 0.1 to 2.5 mm, preferably about 0.4 to 1.7 mm.

The gases used as riser gas, annular bed aerating gas and feedstock atomizing gas are typically selected from air and steam.

The process of this invention is operated at high reactor temperatures typically in the range of 600° to 1000° C. with very short residence times of less than 950 milliseconds, preferably less than 500 milliseconds.

Other materials can also be added to the system having certain catalytic properties, depending upon the desired reactions. The use of suitably selected catalyst and of additional reagents to be introduced together with the oil feed (e.g. hydrogen, methane, etc.) can enhance the extent of upgrading with respect to the simple thermal hydrocracking reactions, e.g. improve the yields of certain gas or liquid fractions and improve the quality of the product.

BRIEF DESCRIPTION OF THE DRAWINGS

The invention will be further described with reference to the accompanying drawings wherein.

Figure 1:
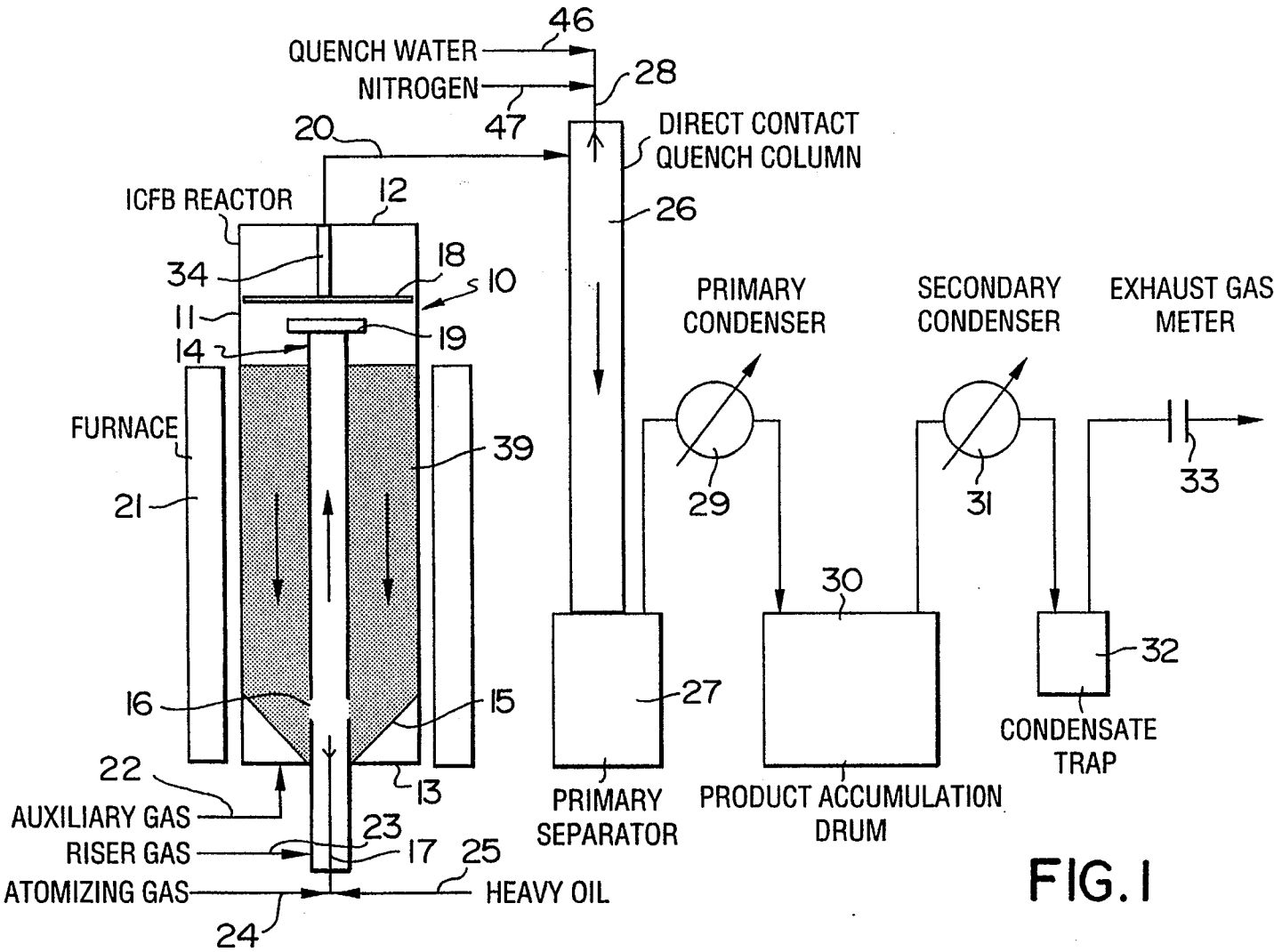
FIG. 1 is a schematic elevational view of an internally circulating aerated bed pyrolysis system according to the invention.
Figure 2:
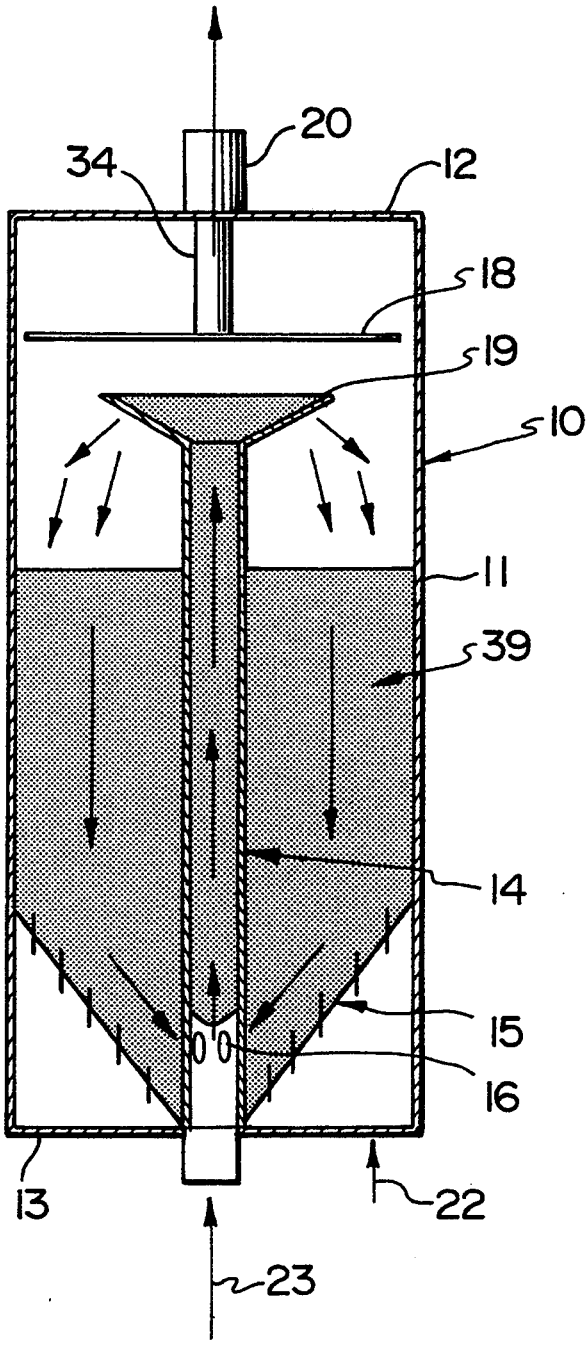
FIG. 2 is a schematic elevational view, in section, of an internally circulating aerated bed unit according to the invention.

The principal component of the apparatus is the internally circulating aerated bed reactor 10 as schematically illustrated by FIGS. 1 and 2. This reactor has an elongated pressure resistant shell or wall 11 having a top wall 12 and a bottom wall 13. Mounted axially within the shell 11 is a tubular riser or draft tube assembly 14 which extends through the bottom wall 13 and upwardly into an upper region of the shell 11, but spaced some distance below the top wall 12. An annular chamber 39 is formed between the riser assembly 14 and the reactor shell 11. This annular space is closed at the bottom end thereof by means of an inverted conical wall 15 having perforations to permit aerated gas to pass upwardly therethrough. The aerating gas is fed upwardly within the annular chamber 39 aerating inert particulate material contained in the annular chamber. The riser also includes a plurality of circumferentially spaced holes or orifices 16 in the bottom region thereof and a short distance above the point of intersection between the inverted conical wall 15 and the riser 14. These orifices 16 provide inlets for the particulate matter contained in the annular chamber 39 to move into the riser 14.

The top end of the riser assembly 14 includes a tee portion 19 for separation of the particles from the gas so that the particles are returned to the annular chamber 39. Positioned in the space between the top end of the riser and the top 12 of the reactor is a gas baffle 18 which has the purpose of reducing the effective volume of the upper solids disengagement section of the reactor. The position of this baffle 18 can be moved thereby varying the effective volume of the upper section and hence the effective gas contact time in the reactor. Product gas is removed through outlet line 20 for downstream quenching and processing.

Returning now to the lower end of the reactor 10, aerating gas is fed into the reactor through inlets 22 and riser gas is fed in through inlet line 23. A connector 24 for atomizing gas and a connector 25 for heavy oil are connected to a nozzle assembly 17 mounted in the bottom end of the riser assembly 14. The outlet of the nozzle 17 is positioned a short distance below the riser orifices 16.

The section of the reactor holding the particulate material is heated by means of a surrounding furnace 21, further details of which are given later in this specification.

The gaseous product line 20 is fed into the top end of a direct contact quench column 26 having a primary separator 27 at the bottom thereof. The top of the quencher is fitted with an injection spray 28 for spraying in quenching water 46 and an optional inert gas 47. Quenching could also be done by an oil or a cooled down product stream. The primary separator 27 collects condensed liquid from the quencher and solids elutriated from the reactor, if any.

The remaining gas/vapour stream from the primary separator 27 is passed through a primary condenser 29 where it is condensed as a water/hydrocarbon emulsion and this is collected in a product accumulation drum 30.

The gas stream leaving the product accumulation drum 30 contains a significant amount of condensable hydrocarbons and water vapour and this is passed through a secondary product condenser 31 where it is further cooled. Condensed liquids from the secondary condenser are collected in a condensation trap 22 and non-condensable gases from the condensate trap 32 are discharged through exhaust gas meter 33.

Figure 3:
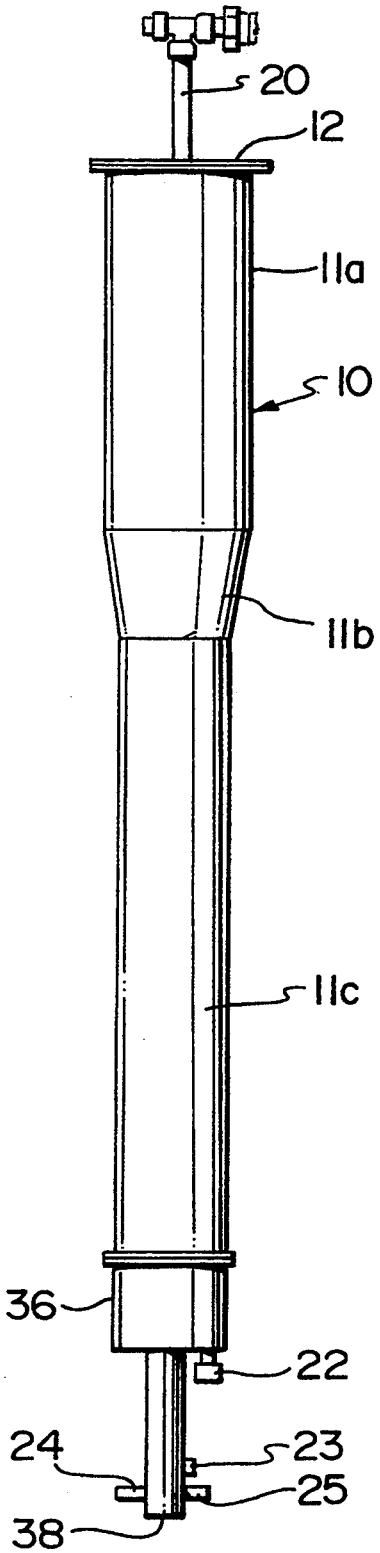
FIG. 3 is an elevational view of an operational internally circulating aerated bed reactor vessel.

FIGS. 3 to 9 show specifics of a pilot plant reactor according to the invention and, as seen from FIG. 3, the reactor shell 11 includes a larger diameter upper section 11*a*, a tapered intermediate section 11*b* and a smaller diameter lower section 11*c*. This reactor was fabricated from 18 gauge Inconel alloy 601 and has an overall height of 2.1 m with an upper section diameter of 203.2 mm and a lower section diameter of 152.4 mm. The flanges and gas fittings were made from 316 stainless steel, with the lower gasket being fabricated from sheet copper and the upper gasket being formed from bonded asbestos gasket material.

Figure 4:
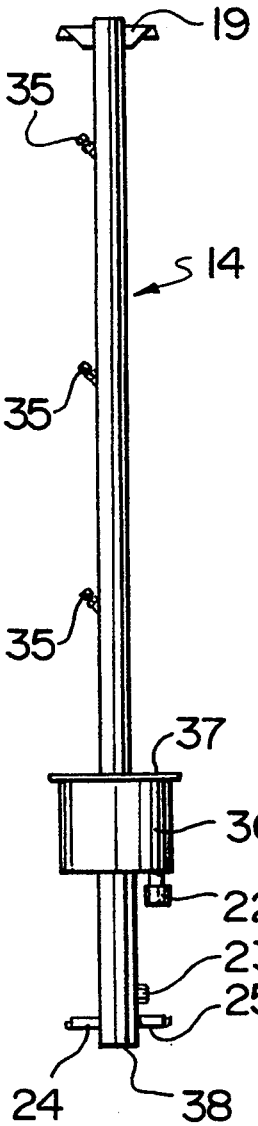
FIG. 4 is an elevational view of a riser assembly for use in the reactor of FIG. 3 coupled with a ballistic particle separator.
Figure 6:
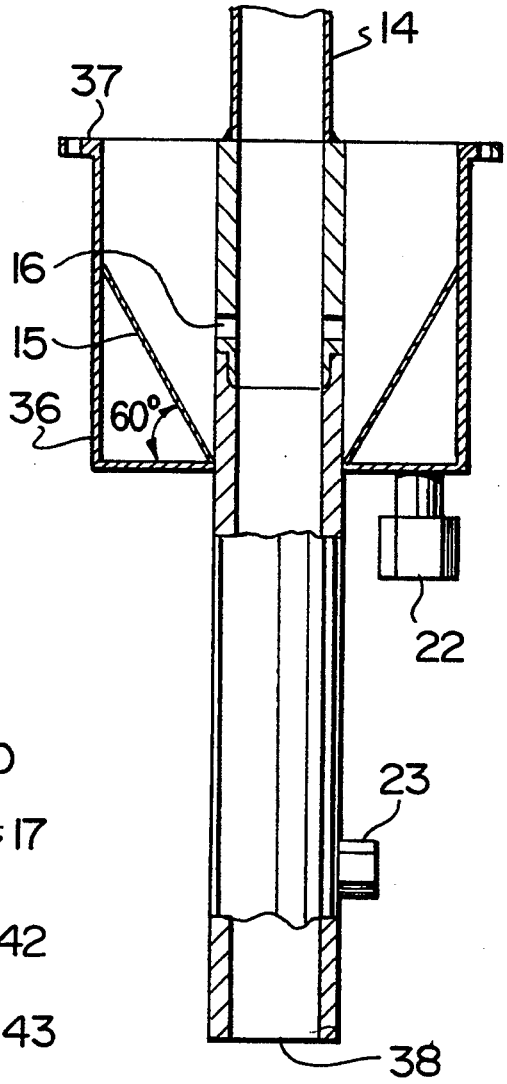
FIG. 6 is an elevational view, in section, of a riser inlet section of a riser assembly of FIG. 4 showing the orifices for solids injection.

The riser assembly can best be seen from FIGS. 4 and 6 and the riser 14 has an overall height of 1.13 m with an inner diameter of 34.9 mm and an outer diameter of 38.1 mm. The riser is equipped with three equally spaced stainless steel thermal wells 35 positioned at 45° from the vertical and 305 mm apart for holding temperature measuring instruments.

Figure 5:
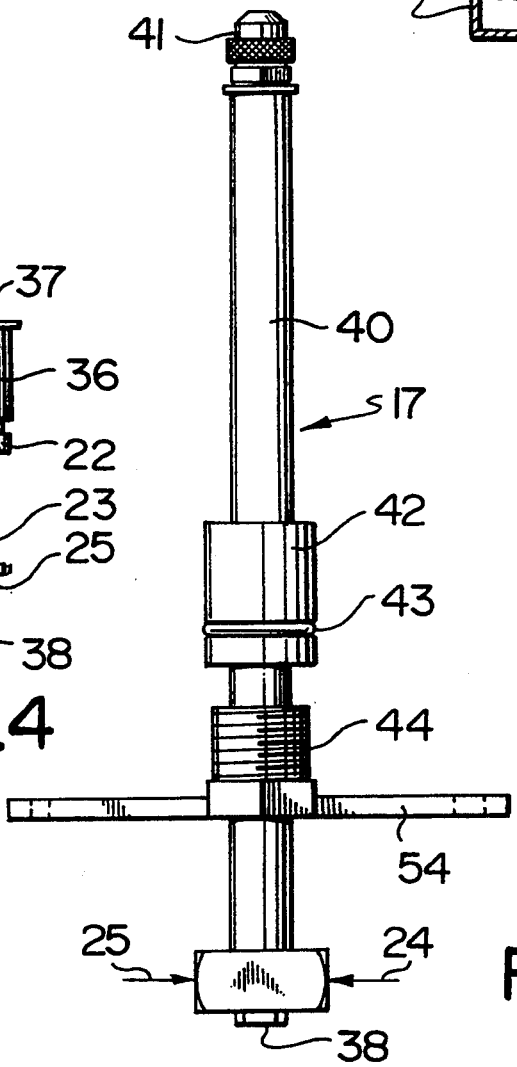
FIG. 5 is an elevational view of a nozzle assembly for use in the reactor of FIG. 3.

The riser assembly also includes a lower riser assembly 36 connected by a flange 37 to the lower end of reactor shell portion 11*c*. The bottom end of the downwardly projecting riser portion comprises a nozzle port 38 for receiving a nozzle assembly 17 as shown in FIG. 5. The nozzle assembly 17 includes a tube portion 40 having a heavy oil spray nozzle 41 on the upper end thereof having a spray angle of approximately 15°. In this particular model of reactor, eight equally spaced orifices 16 were used, each having a diameter of 7.94 mm. The spray 41 of the nozzle assembly 17 is positioned approximately 50.8 mm below the riser orifices. This position ensures that no heavy oil can contact hot metal surfaces within the riser. For mounting into the port 38, the nozzle assembly 17 also includes an annular shoulder 42 with an O-ring 43, a threaded sleeve 44 and a mounting plate 54.

For this particular installation, the inverted conical wall 15 is set at an angle of 60° and contains approximately 600 equally spaced 0.5 mm diameter holes. While the inverted conical bottom is advantageous, it will be appreciated that a flat bottom wall with perforations may also be used.

Figure 7:
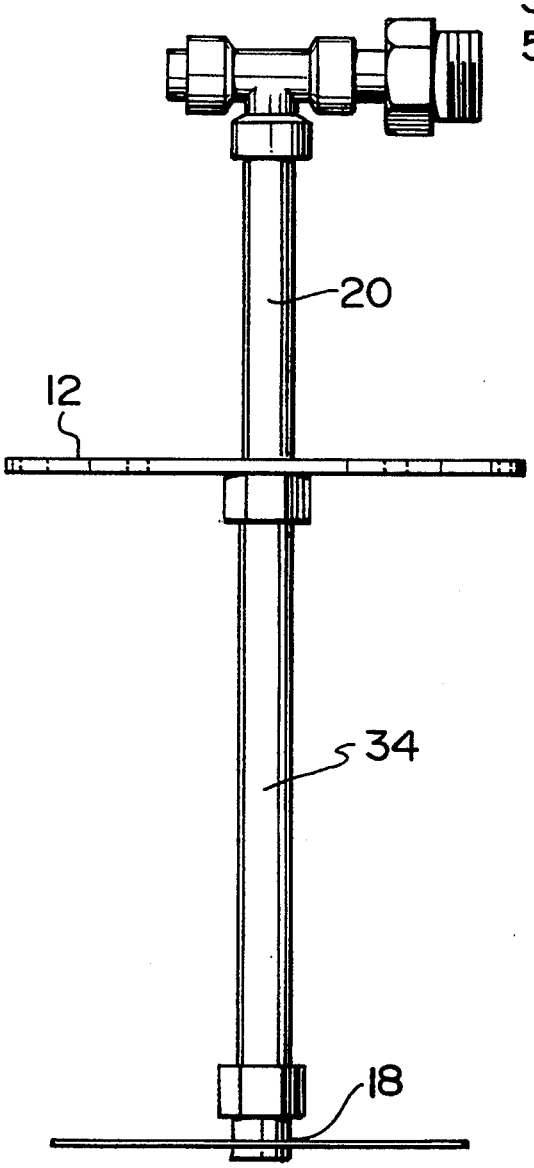
FIG. 7 is an elevational view of a head space gas baffle used in the reactor of FIG. 3.

The head space gas baffle 18 is shown in greater detail in FIG. 7 and it can be seen that it is connected to the top wall 12 of the reactor by way of a transfer line 34. The vertical location of the head space baffle 18 can be adjusted by utilizing transfer lines 34 of different lengths.

Figure 9:
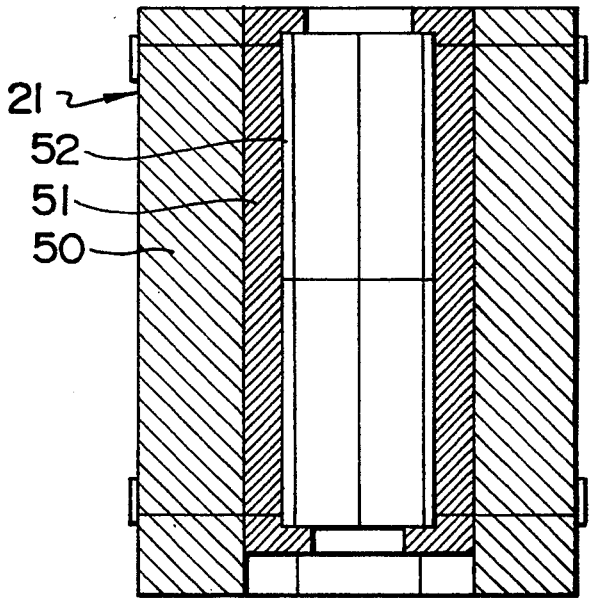
FIG. 9 is an elevational view, in section, of an electric furnace used with the reactor of FIG. 3
Figure 8:
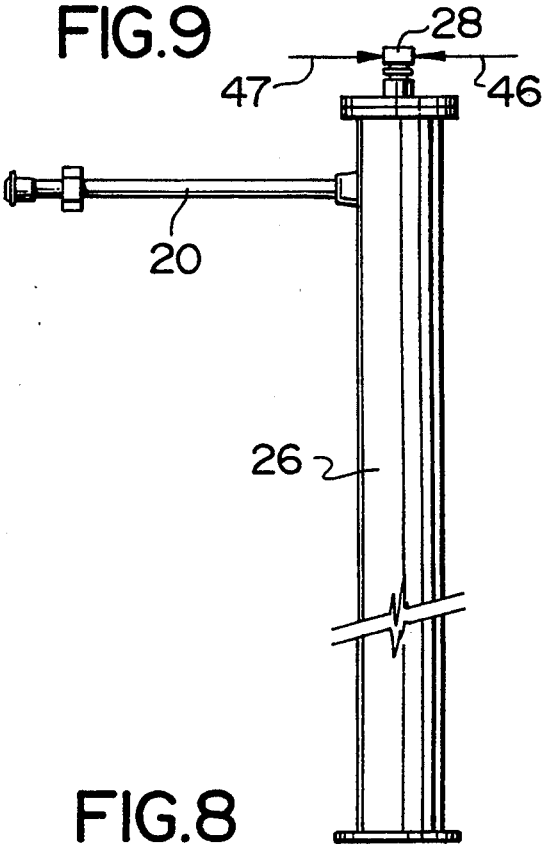
FIG. 8 is an elevational view of a direct contact quench column.

The furnace that is illustrated in FIG. 9 is equipped with eight, quarter round, semi-cylindrical electrical heating elements 52, these being capable of a maximum temperature of 1200° C. An insulating shroud 51 surrounds the heating elements 52 and these are all encased by an insulation layer 50 of Carborundum Fiber fracs refractory mineral fiber.

Figure 10:
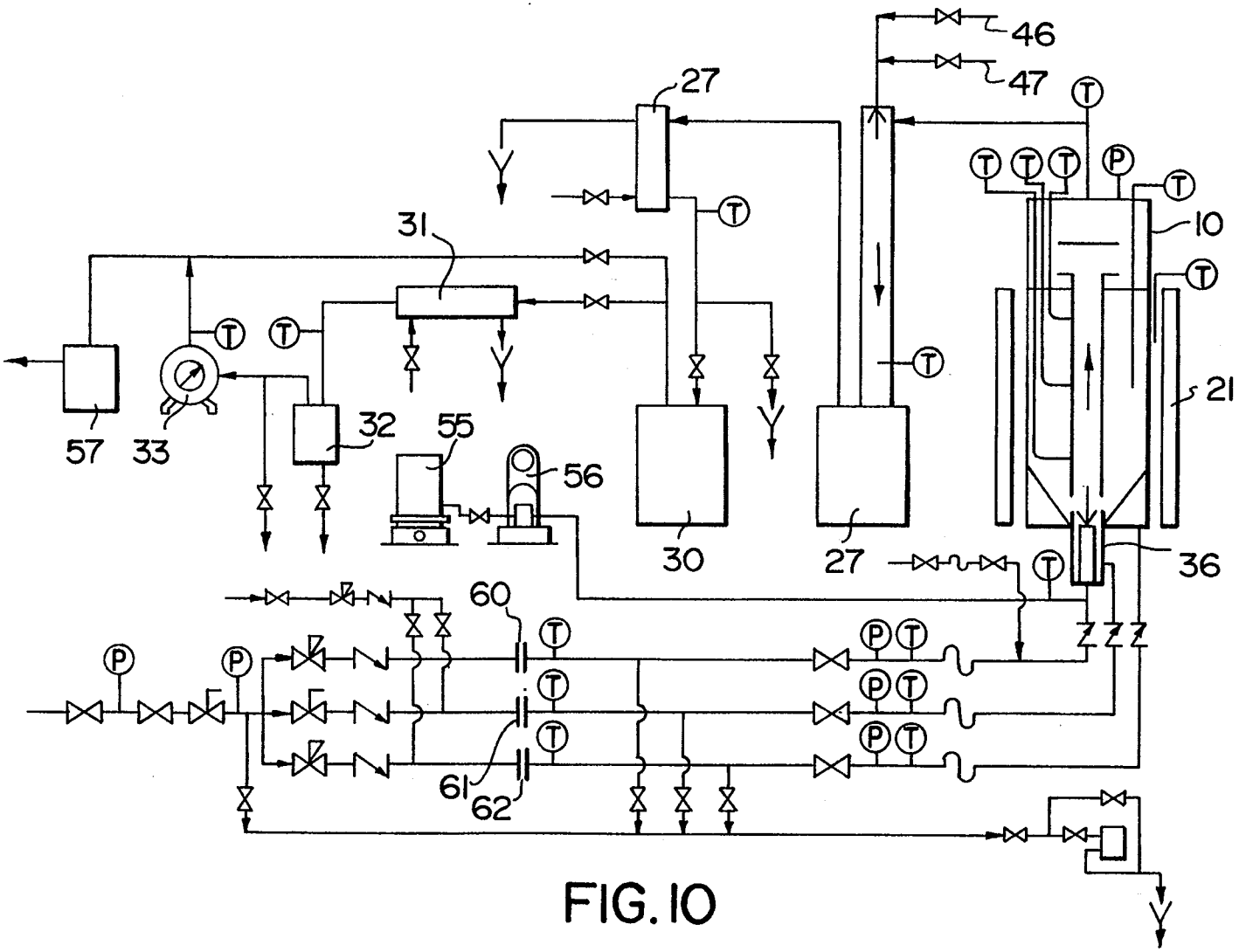
FIG. 10 is a schematic flow sheet showing a complete system according to the invention.

A complete flow sheet is shown in FIG. 10 with pressure monitors being shown by and temperature monitor shown by . This figure shows some features not described in the previous drawings including an oil feed reservoir 55 and a variable speed feed pump 56. The numeral 57 represents an exhaust gas separator for separating the gas exiting from exhaust gas meter 33. Also shown are an atomizing gas orifice meter 60, a riser gas orifice meter 61 and an auxiliary gas orifice meter 62.

A further understanding of this invention may be facilitated by reference to the following example. de

EXAMPLE

A series of experiments were conducted on the apparatus described in detail above and details of four of these experiments are now described. The experiments were all visbreaking tests using as feedstock Amoco Ipiatik heavy hydrocarbon oil, more than 50% by weight of which had a boiling point of 525° C. A detailed analysis of this feedstock is shown later in the example. For the fourth test, the gas head space baffle was raised 76.2 mm in order to observe the effect of increasing the gas residence time.

The aerated particles were 20/40 mesh silica frac sand having a mean particle diameter of 0.52 mm.

The riser gas, the atomizer gas and the auxiliary or aerating gas were either air or steam. It was preferable to use air as the gas at reactor temperatures below 200° C. and to switch to steam when the reactor reached approximately 200°–250° C.

A summary of the operating conditions for four visbreaking tests is shown in Table 1 below:

TABLE 1

Summary of Operating Conditions for Visbreaking Experiments

| Experiment # | 1 | 2 | 3 | 4 |
|---|---|---|---|---|
| Visbreaking Time (min.) | 38 | 91 | 43 | 81 |
| Average Reactor Temperature (°C.) | | | | |
| Furnace | 951 | 920 | 980 | 939 |
| Annulus | 844 | 809 | 852 | 822 |
| Riser | 650 | 658 | 745 | 724 |
| Reactor Outlet | 622 | 654 | 678 | 635 |
| Reactor Vol. ($m^3 \times 10^3$) | | | | |
| Riser | 1.071 | 1.071 | 1.071 | 1.071 |
| Head Space | 2.175 | 2.175 | 2.175 | 4.646 |
| Transfer Line | 0.446 | 0.446 | 0.446 | 0.420 |
| Residence Times (ms) | | | | |
| Riser | 169 | 128 | 149 | 111 |
| Head Space | 319 | 240 | 301 | 504 |
| Transfer Line | 65 | 49 | 62 | 46 |
| Total | 553 | 417 | 512 | 661 |
| Steam Mass Flow (g/s) | | | | |
| Auxiliary | 0.355 | 0.359 | 0.277 | 0.253 |
| Riser | 0.210 | 0.124 | 0.0 | 0.052 |
| Atomizer | 1.080 | 1.540 | 1.490 | 2.160 |
| Oil Fed to Reactor (g) | 2323 | 5555 | 3090 | 6089 |
| Oil Feed Rate (g/s) | 1.02 | 1.02 | 1.20 | 1.25 |
| Steam:Oil Ratio | 1.6:1 | 2.0:1 | 1.77:1 | 2.0:1 |

Following each experiment, the reactor was dismantled and examined. The internally circulating aerated bed reactor was found to be very clean, with virtually no coke deposition on any metal surface. The primary separator was found to contain a small amount of water, sticky tar and coke fines and the product accumulation drum contained a substantial amount of emulsion and free water. In all of the experiments performed, the emulsion was always heavier than the free water. The free water was collected, weighed and disposed of, while the emulsion product was weighed and transferred to plastic sample containers for analysis.

The product emulsion was analyzed for oil, water and solids content. Also, clean product oil samples from the emulsion assay were analyzed for viscosity, density, asphaltenes content, carbon residue, GC/MS and elements C, H, N and S.

A complete synopsis of the emulsion analysis and coke yields is shown in Table 2 below:

TABLE 2

| Experiment # | 1 | 2 | 3 | 4 |
|---|---|---|---|---|
| Aug. Reactor Temp. (°C.) | 631 | 655 | 697 | 650 |
| Total Residence Time (ms) | 553 | 417 | 512 | 661 |
| Oil Feed (kg) | 2.323 | 5.555 | 3.090 | 6.089 |
| Product Emulsion (kg) | 3.089 | 5.701 | 1.518 | 7.842 |
| Oil (kg) | 0.994 | 2.103 | 0.898 | 1.595 |
| Water (kg) | 2.033 | 3.403 | 0.546 | 6.038 |
| Solids (kg) | 0.062 | 0.195 | 0.074 | 0.209 |
| Oil Cut (wt %) | 32.2 | 36.9 | 59.2 | 20.3 |
| Water Cut (wt %) | 65.8 | 59.7 | 35.9 | 77.0 |
| Solids Cut (wt %) | 2.0 | 3.4 | 4.9 | 2.7 |
| Coke Production | | | | |
| Coke Fines in Emulsion (g) | 0.060 | 0.189 | 0.072 | 0.202 |
| Coke on Sand (g, est.) | 0.100 | 0.100 | 0.100 | 0.100 |
| Total Coke (g, est.) | 0.160 | 0.289 | 0.172 | 0.302 |
| Yields | | | | |
| Gas (wt %) | 50.3 | 56.9 | 65.3 | 68.8 |
| Product Oil (wt %) | 42.8 | 37.9 | 29.1 | 26.2 |
| Coke (wt %) | 6.9 | 5.2 | 5.6 | 5.0 |

Clean product oil samples from the emulsion assay were analyzed and a complete summary of the oil and gas analyses appears in Table 3 below:

TABLE 3

| | Feed | 1 | 2 | 3 | 4 |
|---|---|---|---|---|---|
| Aug. Reactor Temp (°C.) | — | 631 | 655 | 687 | 650 |
| Total Re. Time (ms) | — | 553 | 417 | 512 | 661 |
| Elemental | | | | | |
| C wt % | 82.11 | 81.15 | 81.14 | 85.09 | 82.36 |
| H wt % | 10.32 | 8.01 | 6.35 | 5.56 | 5.49 |
| N wt % | 0.51 | 0.61 | 0.64 | 0.66 | 0.56 |
| S wt % | 4.75 | 4.68 | 4.61 | 5.04 | 4.46 |
| Residue wt % | 2.31 | 5.55 | 7.26 | 3.65 | 7.13 |
| CCR wt % | 10.8 | 20.9 | 27.1 | 32.1 | 23.9 |
| Asphaltenes % | 15.6 | 24.7 | 34.9 | 45.9 | 34.4 |
| Maltenes wt % | 84.4 | 75.3 | 65.1 | 54.1 | 65.6 |
| Viscosity (cP) | | | | | |
| 25° C. | 9,540 | 93.7 | 69.2 | 186 | 158 |
| 50° C. | 1,341 | 40.4 | 33.2 | 56.6 | 54.3 |
| 100° C. | 86.1 | 12.1 | 11.3 | 11.7 | 12.6 |
| Density (g/cc @ 25° C.) | 0.9825 | 1.0471 | 1.0812 | 1.1409 | 1.1187 |
| Simdest | | | | | |
| IBP (°C.) | 221 | 216 | 217 | 218 | 210 |
| IBP-300° C. (%) | 7.8 | 15.6 | 12.4 | 9.2 | 13.3 |
| 300-400° C. (%) | 16.6 | 25.3 | 17.9 | 15.0 | 18.7 |
| 400-525° C. (%) | 21.1 | 20.4 | 15.2 | 11.5 | 12.2 |
| +525° C. (%) | 54.4 | 38.7 | 54.6 | 64.2 | 55.8 |
| Produced Gas Analysis (wt %) | | | | | |
| methane | | 36.7 | 19.3 | 23.4 | N.A. |
| ethylene | | 17.7 | 33.3 | 33.0 | |
| ethane | | 7.2 | 5.1 | 7.7 | |
| propylene | | 22.0 | 21.5 | 21.0 | |
| butene | | 10.5 | 10.4 | 5.8 | |
| butadiene | | 5.9 | 10.3 | 9.0 | |

The above tests have established that the concept of an internally circulating aerated bed reactor for the visbreaking of heavy hydrocarbon oils is commercially viable. The unit was found to provide stable operation at high temperatures, with readily achievable high inert solids fluxes and low gas residence times for high heat transfer rates making the unit suitable for high temperature pyrolysis reactions.

An important advantage of the process of this invention is that very low coke production (about 5-7 wt % of feed) is achieved and there was no accumulation of coke on the metal surfaces of the reactor.

The cracked product gas also contained a significant fraction of desirable high value olefins in the order of 50-69 wt % of the produced gas stream.

The above tests were carried out in a pilot plant and it will, of course, be appreciated that a large scale industrial implementation of this technique requires a different reactor configuration. For instance, the heat carrier particles are heated in a typical industrial solid particle heater, such as a fluidized bed heater. At least part of the required heat is generated by the combustion of coke deposited on the inert heat carrier particles before they are re-inserted into the riser. Additional fuel may also be required to heat the particles to the required operating temperature.

While specific embodiments of the process and apparatus aspects of the invention have been shown and described, it should be apparent that many modifications can be made thereto without departing from the spirit and scope of the invention. Accordingly, the invention is not limited by the foregoing description, but it is only limited by the scope of the claims appended hereto.

We claim:

1. A process for ultrapyrolytic upgrading of a heavy hydrocarbon oil feedstock by contacting said feedstock in a confined riser vertical column with finely divided solid particles under ultrapyrolysis conditions including heating at maximum rates of about $10^{5}$° K/s to temperatures of at least 600° C. and residence times of less than 950 milliseconds, said riser forming part of an internally circulating aerated bed reactor with the bottom end of the riser being directly connected to an inlet nozzle feeding said heavy hydrocarbon oil feedstock and the upper end of the riser extending above an annular aerated bed of said finely divided solid particles surrounding the riser and said riser also including a plurality of orifices in a lower region thereof flow connected to a lower region of said aerated bed for controlled delivery of said particles from the aerated bed into the riser, which comprises continuously feeding an atomized stream of said heavy hydrocarbon oil feedstock upwardly through said inlet nozzle into the riser, continuously feeding finely divided solid heat carrier particles from the annular aerated bed into the riser through said orifices, contacting said particles and atomized feed within the riser under ultrapyrolysis conditions, continuously maintaining a level of particles in the aerated bed such that there is a net positive pressure difference between the aerated bed and the riser at the level of the orifices whereby riser gases are prevented from escaping into the annular bed, continuously removing particles and product gas from the upper end of the riser, continuously recycling the removed particles into the aerated bed and continuously withdrawing product gas from the system.

2. A process according to claim 1 wherein a portion of the aerating gases for the aerated bed flows through the orifices into the riser thereby enhancing and controlling radial flow of solids from the aerated bed into the riser and ensuring high solids circulation rates.

3. A process according to claim 1 wherein the ultrapyrolysis reaction is carried out at temperatures in the range of 600° to 1000° C.

4. A process according to claim 1 wherein the residence time in the ultrapyrolysis zone is less than 500 milliseconds.

5. A process according to claim 1 wherein the finely divided solid particles are inert particles.

6. A process according to claim 5 wherein the finely divided inert solid particles have sizes in the range of about 0.1 to 2.5 mm.

7. A process according to claim 6 wherein the particles are silica sand particles.

8. A process according to claim 1 wherein the feedstock is a heavy hydrocarbon oil at least 50% by weight of which boils above 525° C.

9. A process according to claim 1 wherein the reactor includes a head space volume above the upper end of the riser.

10. A process according to claim 9 wherein the head space volume includes a gas baffle located between the upper end of the riser and the upper end of the reactor, said baffle serving to define the head space volume.

11. A process according to claim 1 wherein the inlet nozzle is a pneumatic atomizer positioned immediately below said riser orifices, whereby an atomized spray of heavy oil feedstock is directed onto the inert particles emerging through the orifices without having the spray contacting hot metal surfaces within the riser.

12. A process according to claim 11 wherein the heavy oil spray has droplet sizes of less than 250 $\mu$m.

* * * * *